US005253847A

United States Patent [19]

Utley

[11] Patent Number: 5,253,847

[45] Date of Patent: Oct. 19, 1993

[54] TAP-OUT METERING ROD CONTROL SYSTEM

[75] Inventor: Billy D. Utley, Huntingdon, Tenn.

[73] Assignee: Noranda USA, Inc., Huntingdon, Tenn.

[21] Appl. No.: 984,665

[22] Filed: Dec. 2, 1992

[51] Int. Cl.[5] ..... B22D 41/14

[52] U.S. Cl. ..... 266/95; 266/236

[58] Field of Search ..... 266/78, 94, 95, 236; 222/590, 67, 56

[56] References Cited

U.S. PATENT DOCUMENTS

| | | | |
|---|---|---|---|
| 1,728,888 | 9/1929 | Joerndt et al. | 222/67 |
| 2,816,334 | 12/1957 | Edstrand | 266/95 |
| 3,378,061 | 4/1968 | Von Alt et al. | 222/67 |
| 4,460,163 | 7/1984 | Hornung | 266/236 |

*Primary Examiner*—Scott Kastler

*Attorney, Agent, or Firm*—Keck, Mahin & Cate

[57] ABSTRACT

A system for controlling motion of a metering rod used to regulate the flow of metal from a holding furnace to a tap-out box which comprises a float floating on the surface of the molten metal in the tap-out box, and a metering rod actuator connected to the metering rod to move the metering rod into or out of a tap-out hole interconnecting the holding furnace to the tap-out box. A control valve assembly is mounted on a fixed support and has an inlet orifice connected to an air pressure supply and two outlet orifices, one connected to the metering rod actuator and the other to an exhaust. A blade is connected to the float and is adpated to be moved by it closer or further away from the exhaust orifice so as to control the air exhausted at the outlet orifice of the control valve in proportion to the spacing between the blade and exhaust orifice, resulting in variation in the air pressure at the outlet connected to the metering rod actuator depending upon the float and blade positions.

2 Claims, 2 Drawing Sheets

TAP-OUT METERING ROD CONTROL SYSTEM

This invention relates to a novel system for controlling a metering rod used to regulate the flow of metal from a holding furnace into a tap-out box which is connected to the head-box of a rollcaster via a launder.

Commonly known metering rod control systems use a float device in the tap-out box which acts upon pneumatic valves to direct air pressure to either end of a pneumatic cylinder. The motion of the cylinder rod acts through a lever arrangement to move the metering rod into or out of the tap-out hole such that the flow of liquid metal from the holding furnace is either switched off or on. The control system is very coarse resulting in instability in the supply of liquid metal to the rollcaster. The variations in flow and pressure head cause difficulty in operating the rollcaster.

It is the object of the present invention to provide a system which insures proportional control of metal flow from the holding furnace to the tap-out box to maintain a constant head level in the tap-out box. This insures stability of liquid metal delivery (no waves in the launder interconnecting the tap out box to the head-box).

The system in accordance with the present invention comprises a float floating on the surface of the molten metal in the tap-out box, a metering rod actuator connected to the metering rod to move the metering rod into or out of a tap out hole interconnecting the holding furnace to the tap-out box, a control valve assembly mounted on the holding furnace or any other fixed support adjacent the holding furnace and having an inlet orifice connected to an air pressure supply and two outlet orifices, one connected to the metering rod actuator and the other to an exhaust, and a blade connected to the float and adapted to be moved by it closer to or further away from the exhaust orifice so as to control the air exhausted a the outlet orifice in proportion to the spacing between the blade and the exhaust orifice, resulting in variation in the air pressure at the outlet of the control valve which is connected to the metering rod depending upon the float and blade positions.

The metering rod actuator is preferably a pneumatic diaphragm actuator having an inlet connected to the outlet of the control valve and an actuating rod connected to the metering rod through a lever arrangement.

BRIEF DESCRIPTION OF THE DRAWINGS

The invention will now be disclosed, by way of example, with reference to the accompanying drawings in which.

Figure 1:
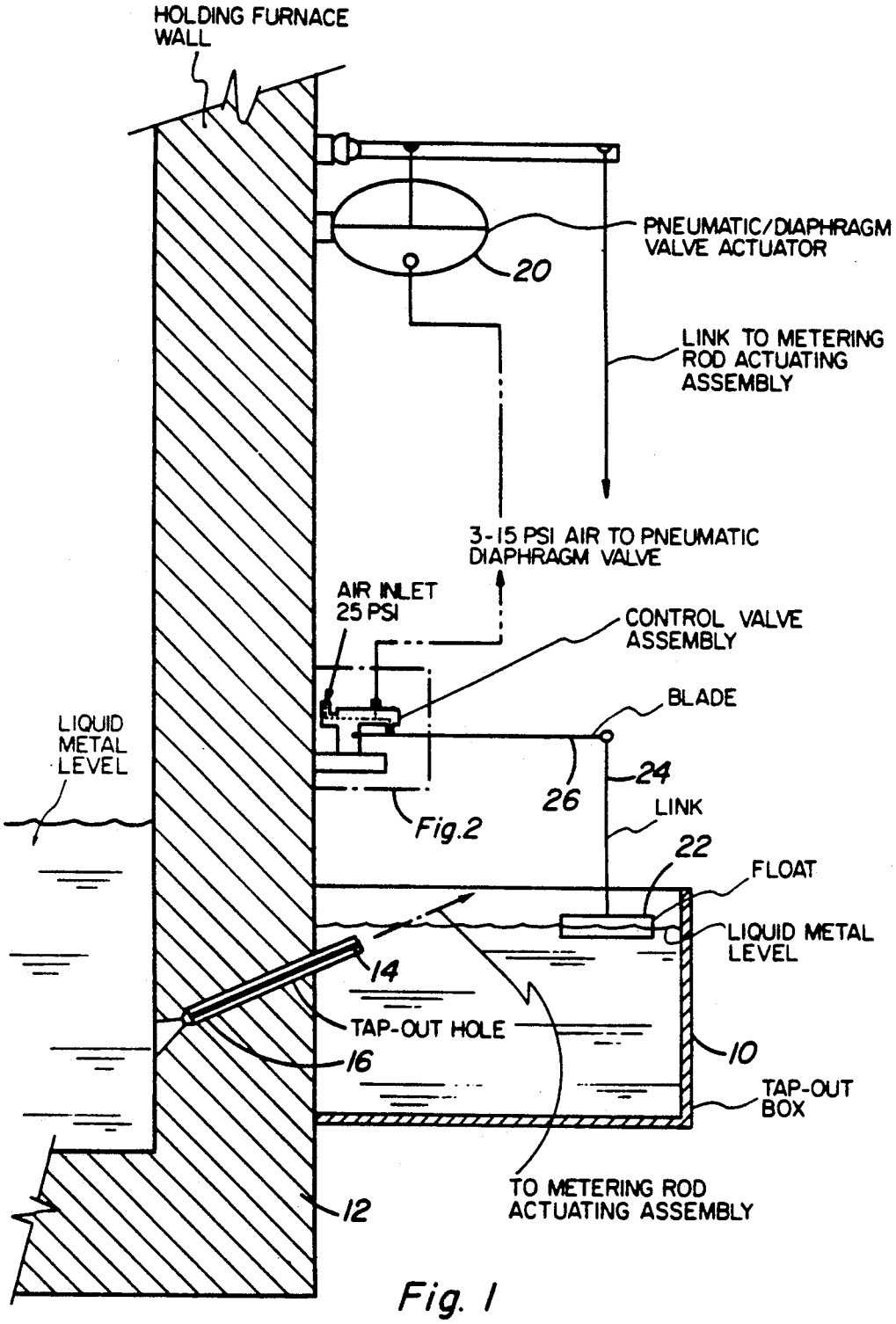
FIG. 1 is a block diagram of the tap-out metering rod control system in accordance with the present invention.
Figure 2:
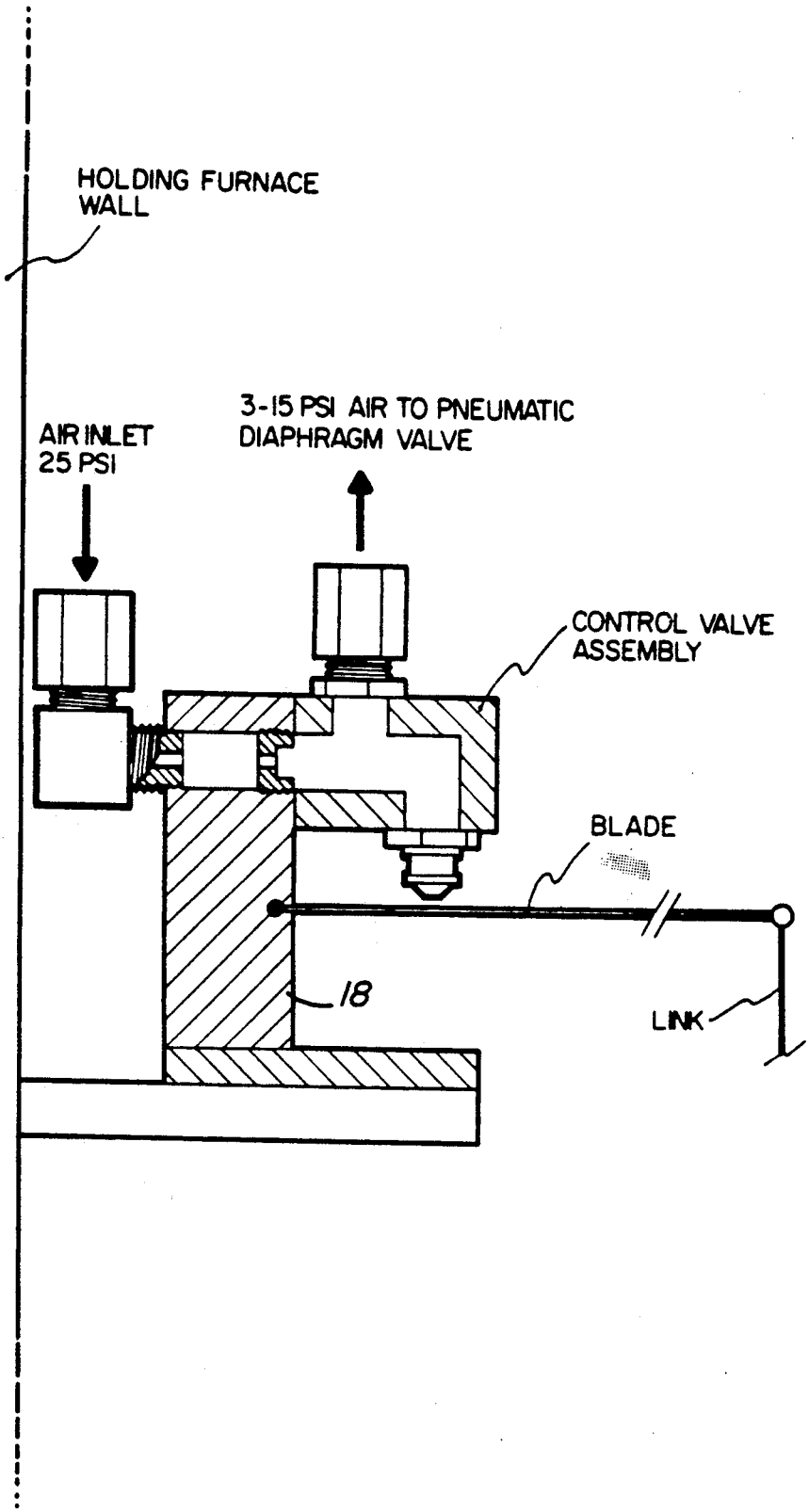
FIG. 2 is a side view of the control valve assembly used in FIG. 1.

Referring to the drawings, there is shown a tap-out box 10 welded to the side wall of a holding furnace 12. A metering rod 14 is inserted into a tap-out hole 16 in the wall of the holding furnace for controlling the flow of metal from the holding furnace to the tap-out box. A control valve assembly 18, made in accordance with the present invention, is positioned on the holding furnace or any other fixed support for controlling the operation of the metering rod into or out of the tap-out hole. The control valve has an inlet orifice A connected to a 25 psi air supply and two outlet orifices, one outlet B connected to a pneumatic diaphragm actuator 20 and a second outlet C connected to an exhaust D. A float 22 is mounted in the tap-out box and connected by a link 24 to a blade 26 to move the blade closer to or further from orifice D. The input air pressure supplied at inlet A is thus exhausted at orifice D in proportion to the spacing between the blade 26 and the orifice D. This results in variation in the air pressure at the outlet orifice B which ranges from 3 to 15 psi depending upon the float and blade positions. The pressure variations at B are transmitted to the inlet of the pneumatic diaphragm actuator which has an actuating rod connected to the metering rod through a link arrangement (not shown) to position the metering rod in the tap-out hole. The flow of liquid metal into the tap-out box is proportional to the variations in the level of metal in the tap-out box. Control of the liquid metal into the caster is thus very stable and allows reliable operation of the rollcasting machine.

The following advantages are derived uniquely from the new control device:

a) proportional control of flow from the holding furnace, b) constant head level in the tap-out box, c) stability of liquid metal delivery (no waves in the launder and head-box, d) great reliability in service combined with minimal periodic cleaning and maintenance.

Although the invention has been disclosed, by way of example, with reference to a preferred embodiment, it is to be understood that it is not limited to such embodiment and that other alternatives are also envisaged within the scope of the following claims.

I claim:

1. A system for controlling motion of a metering rod used to regulate the flow of metal from a holding furnace to a tap-out box comprising:

a) a float floating on the surface of the molten metal in the tap-out box;

b) a metering rod actuator connected to the metering rod to move the metering rod into or out of a tap-out hole interconnecting the holding furnace to the tap-out box;

c) a control valve assembly mounted on a fixed support and having an inlet orifice connected to an air pressure supply and two outlet orifices, one connected to the metering rod actuator and the other to an exhaust orifice; and d) a blade connected to the float and adapted to be moved by it closer or further away from the exhaust orifice so as to control the air exhausted at the outlet orifice of the control valve in proportion to the spacing between the blade and exhaust orifice, resulting in variation in the air pressure at the outlet connected to the metering rod actuator depending upon the float and blade positions.

2. A system as defined in claim 1, wherein said metering rod actuator is a pneumatic diaphragm actuator having an inlet connected to the outlet of the control valve and an actuating rod connected to the metering rod through a lever arrangement.

* * * * *

UNITED STATES PATENT AND TRADEMARK OFFICE

CERTIFICATE OF CORRECTION

PATENT NO. : 5,253,847

DATED : October 19, 1993

INVENTOR(S) : Billy D. Utley

It is certified that error appears in the above-identified patent and that said Letters Patent is hereby corrected as shown below:

On the title page, at [73] Assignee:

"Noranda USA, Inc." should be --Norandal USA, Inc.--

Signed and Sealed this

Second Day of August, 1994

*Attest:*

*Attesting Officer*

BRUCE LEHMAN

*Commissioner of Patents and Trademarks*